US007128213B2

(12) United States Patent
Tung et al.

(10) Patent No.: US 7,128,213 B2
(45) Date of Patent: Oct. 31, 2006

(54) CONVERTIBLE PILL CONTAINER

(75) Inventors: Yaotsung (Mitchell) Tung, Bridgewater, NJ (US); Richard Costa, Bedminster, NJ (US); Matthew Coe, Annandale, NJ (US); Hung Mach, Flushing, NY (US)

(73) Assignee: PharmaDesign Inc., Warren, NJ (US)

( * ) Notice: Subject to any disclaimer, the term of this patent is extended or adjusted under 35 U.S.C. 154(b) by 164 days.

(21) Appl. No.: 10/860,104

(22) Filed: Jun. 3, 2004

(65) Prior Publication Data

US 2005/0269237 A1 Dec. 8, 2005

(51) Int. Cl.
*B65D 83/04* (2006.01)

(52) U.S. Cl. ..... 206/538; 220/524

(58) Field of Classification Search ..... 206/528–539; 220/524; 211/70
See application file for complete search history.

(56) References Cited

U.S. PATENT DOCUMENTS

| | | | | |
|---|---|---|---|---|
| 3,393,795 | A * | 7/1968 | Covert, Jr. | 206/534 |
| 4,083,452 | A * | 4/1978 | Rossmo | 206/533 |
| 4,261,468 | A * | 4/1981 | Krebs | 206/538 |
| 5,782,359 | A * | 7/1998 | McAllister et al. | 206/538 |
| 5,921,395 | A * | 7/1999 | Alexander | 206/538 |
| 6,126,010 | A * | 10/2000 | Kogen | 206/538 |

* cited by examiner

*Primary Examiner*—Luan K. Bui
(74) *Attorney, Agent, or Firm*—Watov & Kipnes, P.C.

(57) ABSTRACT

A pill container includes a plurality of compartments arranged radially from one another, each of the plurality of compartments adapted for receiving and retaining at least one pill and reversibly secured by a corresponding closure; and a movable tab located in each of the plurality of compartments, each movable tab is configured to reversibly move from a first position to a second position within the corresponding compartment to partition the compartment into two discrete compartment portions.

6 Claims, 5 Drawing Sheets

CONVERTIBLE PILL CONTAINER

FIELD OF THE INVENTION

The present invention relates to pill containers or boxes, and more particularly to a pill container designed to accommodate dosable solid products for convenient storage/carry, and dispensing.

BACKGROUND OF THE INVENTION

Pill containers, also known as pill boxes, are cases for housing medications such as pills, tablets, or capsules. Such cases can be used to store and dispense pills such as in a pharmacy or may be made compact to function as personal pill containers used by consumers not only to store and dispense pills but also to carry pills such as in a purse, pocket, or the like.

Personal pill containers allow users to pack limited individualized dosages of one or more medications, and thus enable convenient short-term carry. Since the number or amount of dosages held in such personal pill containers is normally limited, the user must periodically refill the container typically from standard pill containers supplied by the pharmacist. Such small, pocket-sized pill containers, which have been used for years, allow the user to pre-fill the container with medication to be dispensed for that day, and to conveniently carry it with them. These personal pill containers have been found to enhance the ease and regularity of administration by reminding the user of the proper time for dispensing of pills in a more consistent manner. In addition, their small size and compact profile make them especially convenient for individuals needing to take medications at scheduled intervals.

Personal pill containers are typically fabricated to include multiple compartments, which are generally individually accessible by the user through a corresponding closure. Each compartment is adapted to receive and retain a single grouping or dose of one or more medications to be taken at a particular time, which may be individually identified by indicia printed on the closure. In this manner, the personal pill containers can be implemented to enable users to take their medication at the appointed times. While traditional personal pill containers facilitate the prompting of use and transportation of medications, such containers have been found to be inadequate when the user is required to take more than one kind of medication at different time intervals during the day. In such an instance, the user often may not be able to distinguish the different medications, and thus, may erroneously take the medications at improper times.

Accordingly, there is a need for pill containers, which are capable of accommodating one or more dosable ingestible products typically in the form of pill medications which may be administered at same or different time intervals and/or groupings during the day, while maintaining ease of use and storage and carry convenience.

The pill containers may be made compact so that they can function as personal pill containers and therefore be convenient to carry by the user.

SUMMARY OF THE INVENTION

The present invention relates generally to a pill container having multiple compartments designed to hold several groupings or doses of one or more ingestible products such as medications for convenient storage and when in the form of a personal pill container, easy to carry. Each of the multiple compartments is designed to form a single area for holding a single pill grouping, or be easily converted into multiple areas for separately holding multiple pill groupings. The multiple compartments may further include indicia to assist the user to identify the pills contained therein and when in the form of a personal pill container, which dosages are to be administered at a particular scheduled time. The pill container of the present invention also permits the user to visually determine whether a particular grouping or dose had been taken. The present invention further provides the user with a simple tool to organize, store, and remember the proper schedule for administering medication, all within a personal pill container that is compact so that is may be readily carried in a pocket, purse or the like.

In one aspect of the present invention, there is provided a pill container comprising:

at least one compartment for receiving and retaining at least one pill; and means operatively associated with the at least one compartment for reversibly partitioning each compartment into separate compartment portions.

In a more particular aspect of the present invention, there is provided a pill container comprising:

a plurality of compartments arranged radially from one another, each of the plurality of compartments adapted for receiving and retaining at least one pill and reversibly secured by a corresponding closure; and a movable tab located in each of the plurality of compartments, each movable tab configured to reversibly move from a first position to a second position within the corresponding compartment and partition the compartment into two compartment portions.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is directed generally to a pill container suitable for storing and dispensing one or more medications. In one aspect of the invention, the pill container is in the form of a personal pill container for storing and dispensing medication, and which can be easily carried by the user. The personal pill container will typically include some indication of the day and time a medication should be taken. Reference herein to pill container shall include personal pill containers.

The personal pill container of the present invention allows the user to customize the configuration of the medication storage and dispensing area as desired in a simple and easy manner. In one form of the present invention, the pill container includes multiple compartments each configurable for storing a single grouping or several groupings of medications. The pill container can readily be modified through a simple mechanism to accommodate within a compartment a single grouping of medication for yielding a single dispensable dose or multiple groupings of medication, each of which can be maintained in a pill compartment portion or area. With the separate pill compartment portions, the user can easily administer each grouping of medication in the proper dosage at different time intervals as required. The pill container of the present invention may be designed and dimensioned especially for use by pharmacists to store and dispense pills and with respect to personal pill containers to store, dispense and carry medications making the personal pill container especially useful for individuals exhibiting limited finger dexterity such as those suffering from the symptoms of arthritis. The pill container of the present invention is simple and cost efficient to fabricate and to implement.

Figure 1:
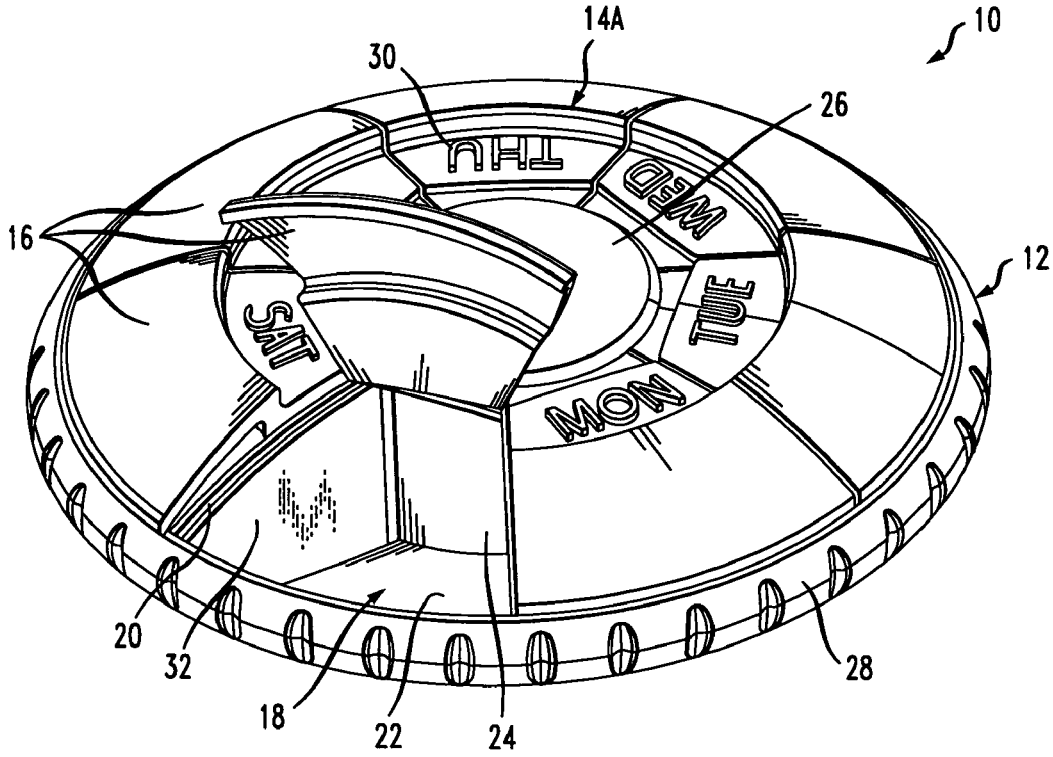
FIG. 1 is a top perspective view of a pill container shown with an open compartment having a single compartment portion functioning as a receiving area for pills in accordance with one embodiment of the present invention.
Figure 2:
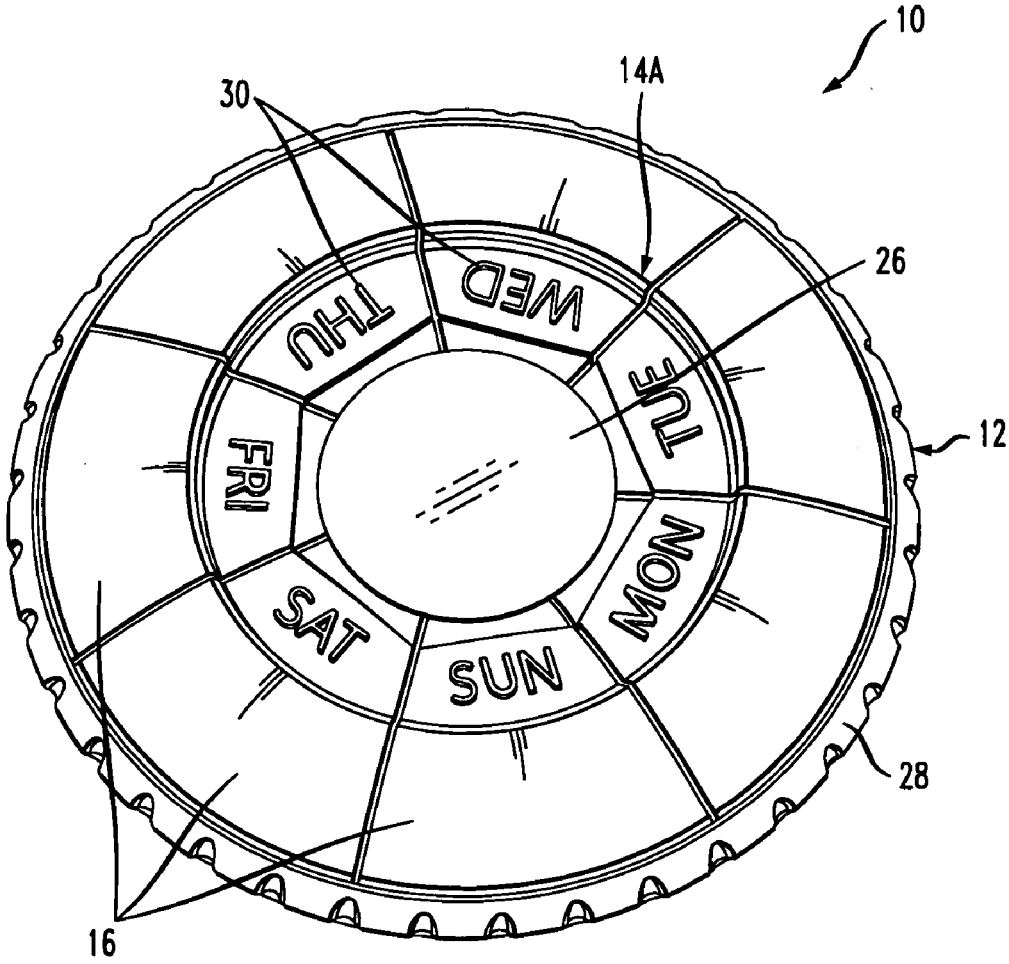
FIG. 2 is a top plan view of the pill container shown in FIG. 1.
Figure 3:
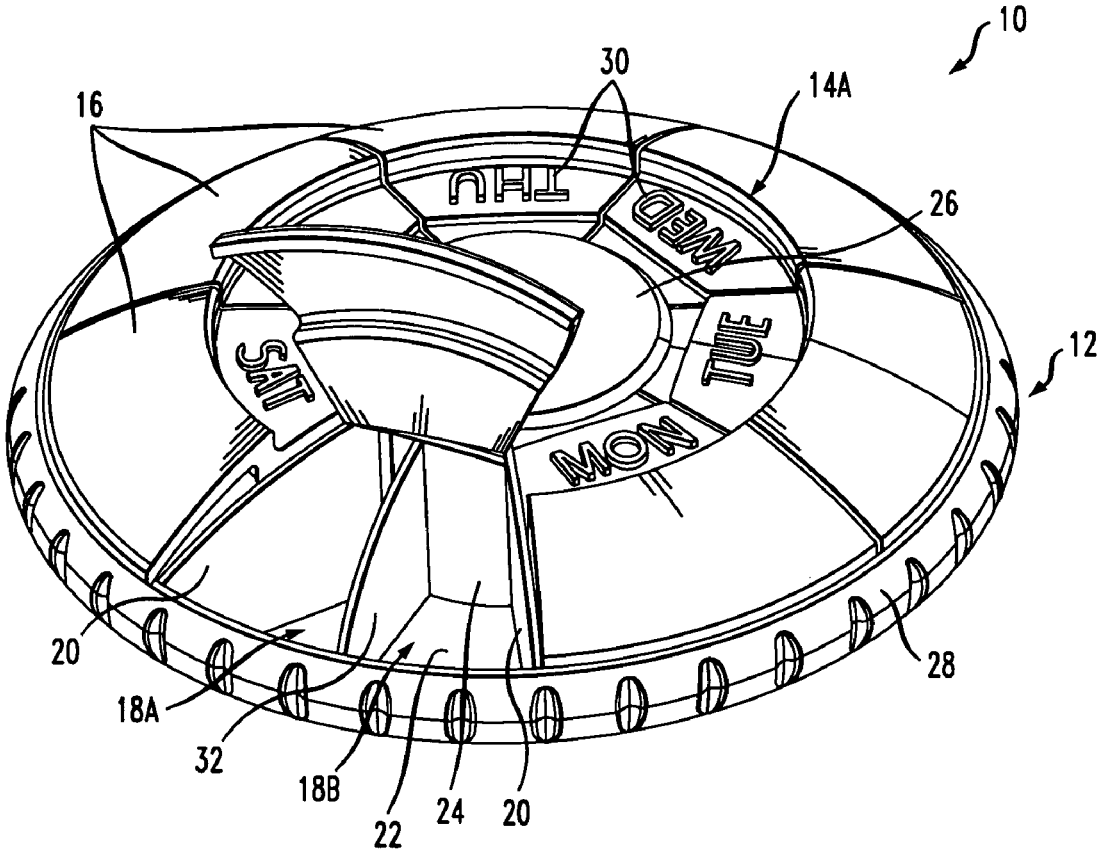
FIG. 3 is a top perspective view of the pill container shown in FIG. 1 with an open compartment having multiple pill storage compartment portions.

With reference to FIGS. 1 to 3, there is shown for one embodiment of the present invention a convertible personal pill container identified generally by the reference numeral 10, and referred herein as "pill container." It will be understood that the pill container exemplified in the drawings is a personal pill container particularly useful for individuals but is equally applicable for use, for example, by pharmacists for storing and dispensing medication on a generally larger scale.

The pill container 10 is useful for storing and dispensing dosable ingestible products including but not limited to medications, vitamins, nutraceuticals, and pharmaceutical compositions such as in the form of pills, tablets, capsules and the like. The pill container 10 includes one or more individual compartments for storing a single grouping of pills or multiple groupings of pills, which may be divided into smaller compartment portions as hereinafter described.

It is understood that the number of compartments can vary depending on the number or groupings of pills, or combinations of pills to be stored and carried, and also depending on the time period needed for such storage and dispensing. The compartments of the pill container 10 are adapted to be converted through a simple actuation means as hereinafter described for converting a single pill compartment for storing a single grouping of pills to multiple compartment portions each portion holding one of a multiple grouping of pills in a separate discrete arrangement, with each of the storage compartments and portions thereof preferably dimensioned to accommodate enough pills, tablets and/or capsules to suit the user. It will be understood that when the pill container is used by a pharmacy the storage capacity of each storage compartment will be greater than the compartment for the personal pill containers. A "grouping" is defined herein to encompass one or more ingestible products that may be the same or different and may be intended to be dispensed at the same time.

Figure 4:
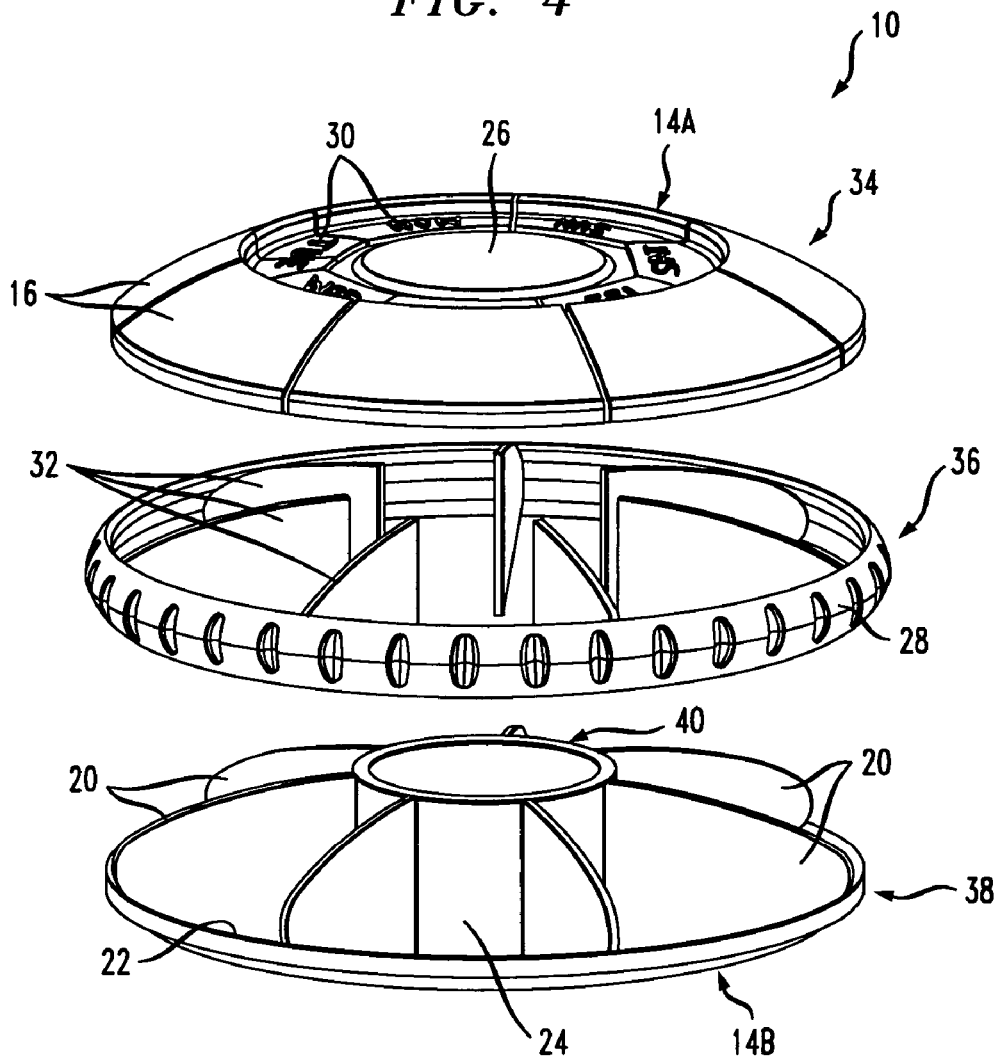
FIG. 4 is an exploded assembly view of the pill container of FIG. 1.

The pill container 10 includes a disc-like body 12 having a top components 14A, a bottom components 14B (as best shown in FIG. 4), a central portion 26, and a flange component 28. The flange component 28 is slidably movable in the clockwise or counterclockwise direction with respect to the top and bottom components 14A and 14B. The body 12 of the pill container 10 further includes a plurality of lids 16 extending radially from the central portion 26 along the upper portion of the top component 14A, and a plurality of pill storage compartments 18 each having a corresponding lid 16. The lids 16 can be opened to provide access to each of the corresponding compartments 18. The compartments 18 can be adapted to accommodate multiple groupings of medication for dispensing over a period of time spanning multiple hours or multiple days depending on the user's requirements.

The storage area of the compartment 18 is defined by the lid 16, opposed dividers 20, a back wall 24 and a base section 22. In the present embodiment, the body 12 of the pill container 10 includes seven lids 16 for enclosing seven corresponding compartments 18. In one embodiment, each of the compartments 18 may correspond to a day of the week on which the user can administer the pills that may be contained therein.

Referring specifically to FIGS. 1 and 3, the flange component 28 is adapted to move radially relative to the top and bottom components 14A and 14B. The pill container 10 further includes a movable tab 32 located in each of the compartments 18 and rigidly attached to the inner side of the flange component 28. Movement of the flange component 28 causes the movable tab 32 to move from a first position (as shown in FIG. 1) to a second position (as shown in FIG. 3). As best shown in FIG. 3, the movable tab 32 in the second position partitions the compartment 18 into discrete pill compartment portions 18A and 18B suitable for individually storing multiple groupings of medication. The movable tab 32 can be easily urged to the desired position by a single movement of the flange component 28.

Referring to FIG. 4, the pill container 10 is assembled from a cover assembly 34, a flange assembly 36, and a compartment assembly 38. The cover assembly 34 forms part of the top component 14A thereof, and includes the lids 16, the central portion 26 and optional indicia 30 identifying each compartment 18 (e.g., Saturday). The cover assembly 34 is configured to mate with the upper portion of the flange assembly 36. The flange assembly 36 includes the flange component 28 and the rigidly attached movable tabs 32 arranged radially apart from one another.

The compartment assembly 38 forms part of the bottom component 14B, and includes a central hub 40 from which the back wall 24 of the compartments 18 is formed in the assembled pill container 10, and the dividers 20 arranged in a radially spaced apart relationship around the hub 40 and supported by the bottom component 14B. The compartment assembly 38 is configured to mate with the lower portion of the flange assembly 36. Each of the movable tabs 32 of the flange assembly 36 is positioned between adjacent dividers 20 of the compartment assembly 38. The cover assembly 34 is positioned relative to the compartment assembly 38 with each of the dividers 20 aligned between adjacent lids 16.

With reference to FIGS. 1 to 4, the operation of the pill container 10 will now be described herein. Referring specifically to FIG. 1, in one mode of operation, the user places a single grouping of one or more pills in each of the compartments 18 corresponding, for example, to the day on which the medication is to be taken in the usual manner. For a given day, the user opens the corresponding compartment 18 identified by the indicia 30 (e.g., Monday), and administers the dosage group contained therein. In an alternative mode of operation, the user may require two or more groupings each to be administered at different intervals in a given day. The pill container 10 accommodates such a requirement through the actuating mechanism as described above. The user rotates the flange component 28 sufficiently to slidably move the movable tab 32 to the appropriate position within the compartment 18 (as best shown in FIG. 3). In this mode of operation, the user can place two groupings of pills in the thus formed separate compartment portions. In this manner, the user can administer one grouping at one time interval and another grouping at a different time interval in a given day. The user can return the pill container 10 to the first mode of operation by a rotating the flange component 28 back to the initial position.

Figure 5A:
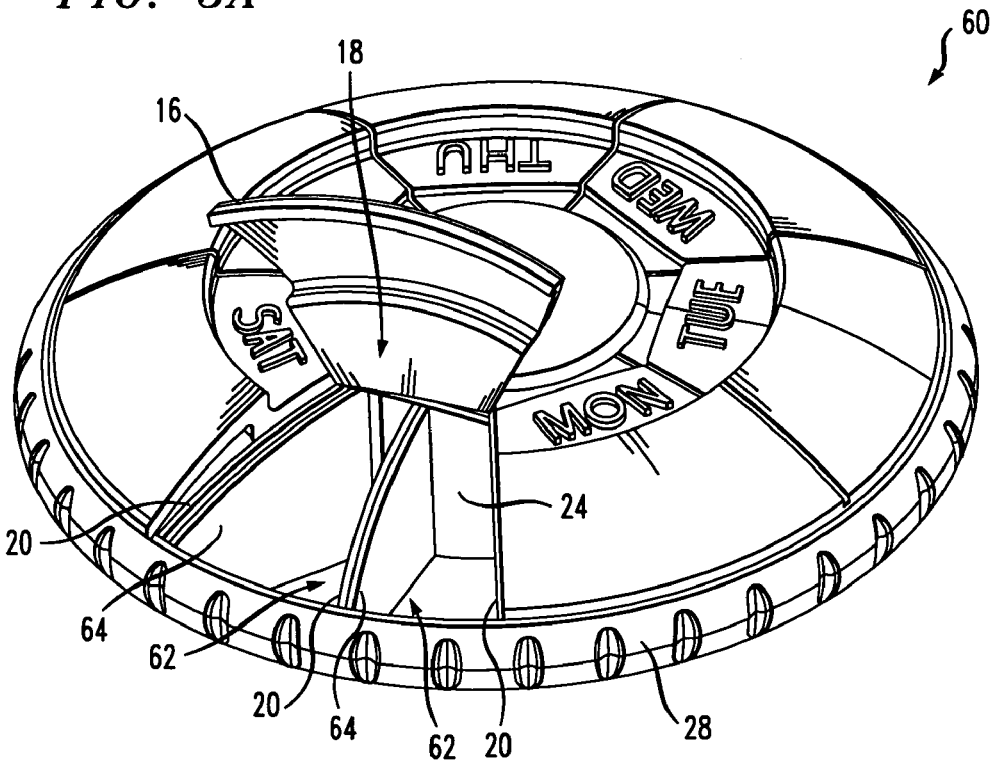
FIG. 5A is a perspective view of a pill container for a second embodiment of the present invention.
Figure 5B:
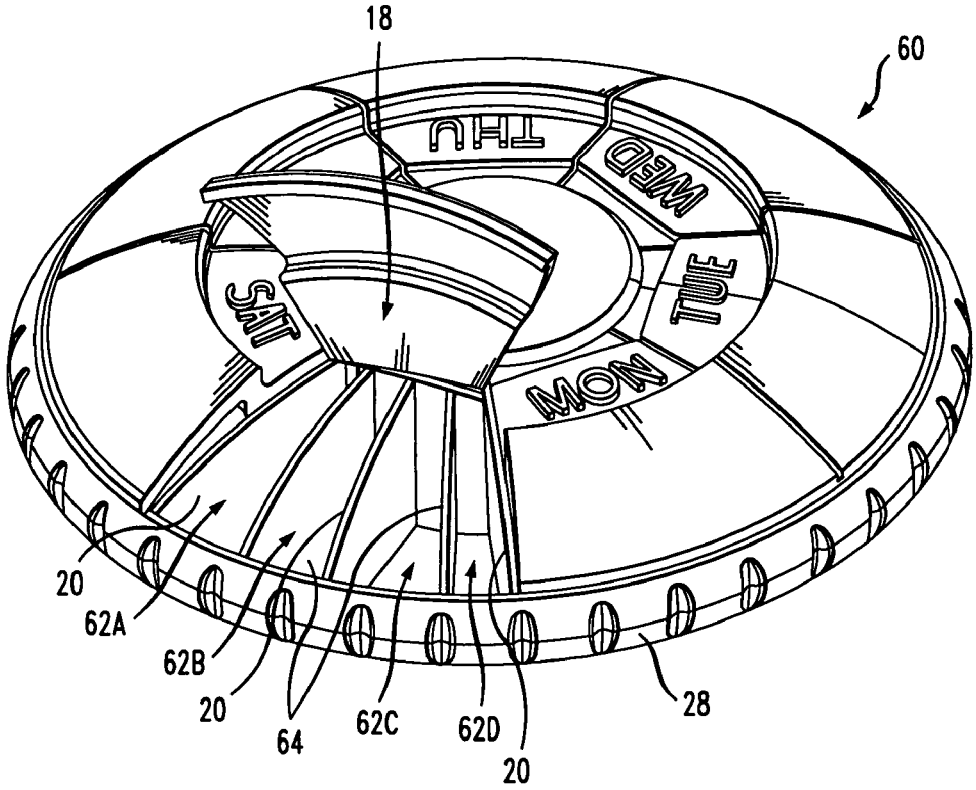
FIG. 5B is a perspective view of the pill container shown in FIG. 5A with an open compartment having multiple pill storage compartment portions.

With reference to FIGS. 5A and 5B, a pill container 60 is shown for a second embodiment of the present invention. The pill container 60 contains similar structural features as the pill container 10. The pill container 60 includes a plurality of storage compartments 18 each having two compartment portions 62 which are defined in combination by fixed dividers 20. Each of the compartment portions 62, further includes a movable tab 64 that is shown initially positioned flush against the corresponding divider 20 for one mode of operation. Similar to the previous embodiment, the movable tabs 64 are each attached to the flange component 28 for sliding movement within the compartment 18. The movable tabs 64 are urged through the flange component 28 to a second position away from the fixed dividers 20 as best shown in FIG. 5B. As a result, the compartment portions 62 of FIG. 5A are suitably partitioned to yield four compartment portions 62A–62D.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A pill container, comprising:

at least one compartment defined between a pair of fixed dividers for receiving and retaining at least one pill; and a rotatable member adapted for rotational movement relative to the at least one compartment;

at least one tab located within the compartment and fixedly attached to the rotatable member, said at least one tab is slidably movable between the corresponding pair of fixed dividers upon urging by the rotatable member from a first position to a second position to partition the compartment into discrete pill compartment portions.

2. The pill container of claim 1 member is a flange component extending along the outer periphery of the pill container.

3. The pill container of claim 1 further comprising at least one closure corresponding to said at least one compartment thereby providing access to the at least one pill stored therein.

4. The pill container of claim 1 wherein said container comprises a disc-shaped body.

5. The pill container of claim 4 comprising a plurality of compartments each located radially from one another.

6. A pill container, comprising:

a plurality of compartments arranged radially from one another, each of said plurality of compartments defined between a pair of fixed dividers and adapted for receiving and retaining at least one pill and including a corresponding closure for reversibly securing at least one pill within the compartment;

a rotatable flange component extending along the outer periphery of the pill container; and at least one movable tab located in each of said plurality of compartments, each of said at least one movable tab being fixedly attached to the rotatable flange component, and adapted to move between first and second positions within the compartment upon urging by the flange component.

* * * * *

UNITED STATES PATENT AND TRADEMARK OFFICE

CERTIFICATE OF CORRECTION

PATENT NO. : 7,128,213 B2
APPLICATION NO. : 10/860104
DATED : October 31, 2006
INVENTOR(S) : Yaotsung (Mitchell) Tung et al.

It is certified that error appears in the above-identified patent and that said Letters Patent is hereby corrected as shown below:

Column 6, line 10, claim 2, please insert --wherein the rotatable-- between the words "claim 1" and "member".

Signed and Sealed this

Second Day of January, 2007

JON W. DUDAS
*Director of the United States Patent and Trademark Office*